US006368014B1

(12) United States Patent
Culver et al.

(10) Patent No.: US 6,368,014 B1
(45) Date of Patent: Apr. 9, 2002

(54) GROUND WORKING DEVICE

(75) Inventors: Larry G. Culver, Sherwood Park; Ray W. Gillard, Fort Saskatchewan, both of (CA)

(73) Assignee: Road Badger, Inc., Edmonton (CA)

( * ) Notice: Subject to any disclaimer, the term of this patent is extended or adjusted under 35 U.S.C. 154(b) by 0 days.

(21) Appl. No.: 09/505,714

(22) Filed: Feb. 17, 2000

(51) Int. Cl.[7] ..... E01C 23/06
(52) U.S. Cl. ..... 404/90; 404/92
(58) Field of Search ..... 404/90, 91, 93, 404/94, 124; 172/51, 54.5, 84, 85, 108

(56) References Cited

U.S. PATENT DOCUMENTS

| | | | | | |
|---|---|---|---|---|---|
| 2,397,782 | A | * | 4/1946 | Flynn | 94/40 |
| 2,795,176 | A | * | 6/1957 | O'Hara | 97/40 |
| 3,224,347 | A | * | 12/1965 | Seaman | 94/40 |
| 3,598,027 | A | * | 8/1971 | Swisher, Jr. | 94/40 |
| 3,732,023 | A | * | 5/1973 | Rank et al. | 404/90 |
| 4,175,886 | A | * | 11/1979 | Moench et al. | 404/90 |
| 4,512,090 | A | | 4/1985 | Billings | 37/117.5 |
| 4,573,826 | A | * | 3/1986 | Piovesan | 404/90 |
| 4,967,850 | A | | 11/1990 | Bargfrede et al. | 172/197 |
| 5,092,658 | A | * | 3/1992 | Smith | 299/39 |
| 5,224,555 | A | | 7/1993 | Bain et al. | 172/772.5 |
| 5,259,692 | A | | 11/1993 | Beller et al. | 404/90 |
| 5,263,769 | A | * | 11/1993 | Pharr et al. | 299/39 |
| 5,354,147 | A | * | 10/1994 | Swisher, Jr. | 404/90 |
| 5,407,014 | A | | 4/1995 | Tranmer | 172/197 |
| 5,795,096 | A | | 8/1998 | Culver | 404/90 |
| 6,092,608 | A | * | 7/2000 | Leger | 172/15 |

* cited by examiner

*Primary Examiner*—Thomas B. Will
*Assistant Examiner*—Kristine Markovich
(74) *Attorney, Agent, or Firm*—Anthony R. Lambert

(57) ABSTRACT

A ground working device is formed from a sub-frame having a first side and a second side, plural discs mounted for rotation on the sub-frame between the first side and the second side about an axis that extends from the first side to the second side; and a set of scoops mounted on each disc in ground contacting position. The scoops efficiently lift the ground surface material, which falls to the ground in a sorted manner with coarser material on top. A motor is operatively connected to the plural discs for rotating the discs about the axis. Each scoop in each set of scoops has a ground working face that extends transversely to the disc on which the respective scoop is mounted. The scoops each have concave ground contacting surfaces. Each scoop is received in a respective slot in the disc in which the respective scoop is mounted. The ground working device is mounted on a main frame, which is provided with ground engaging wheels. The sub-frame is retractably mounted on the main frame.

6 Claims, 13 Drawing Sheets

FIG. 7B
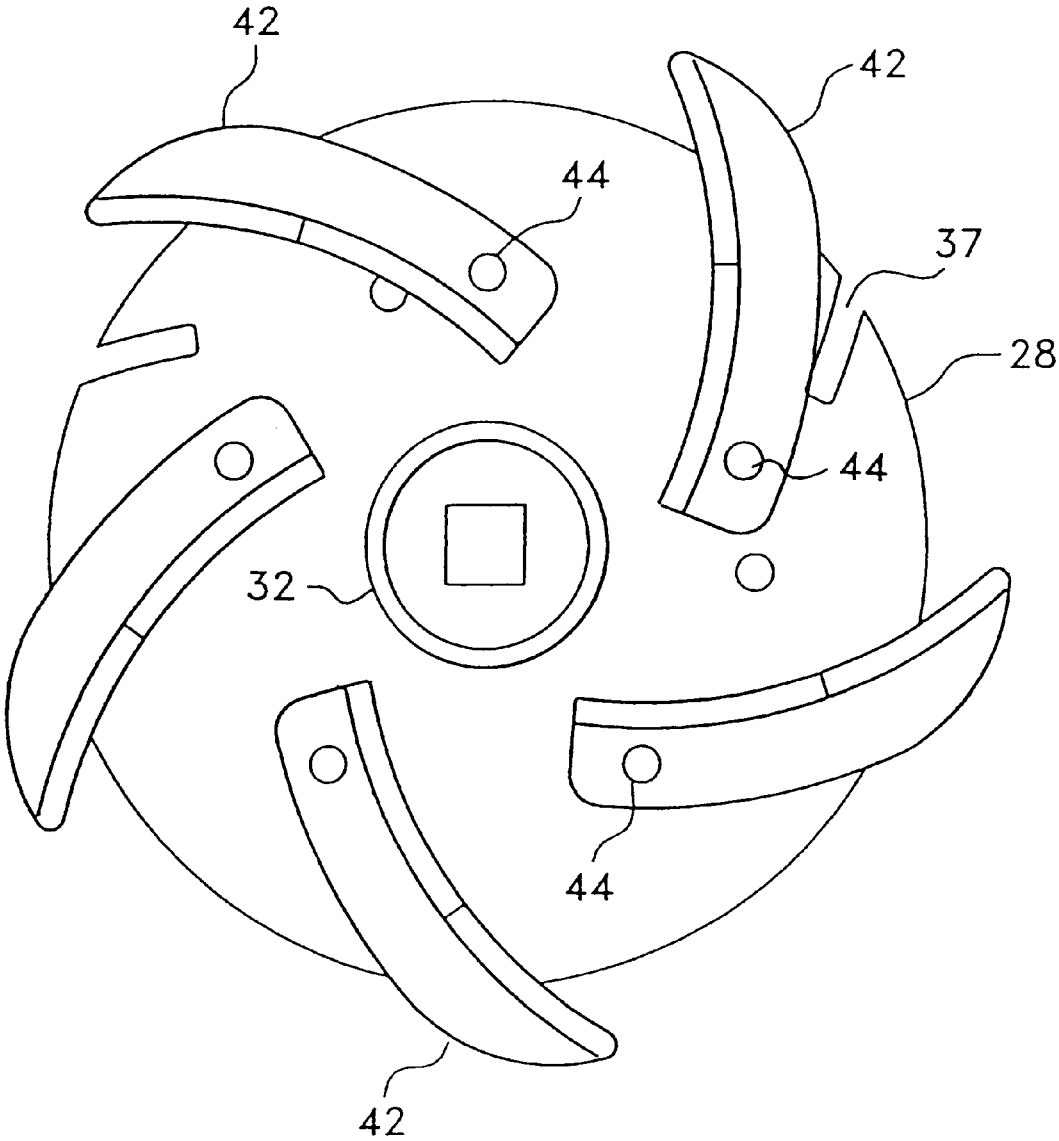
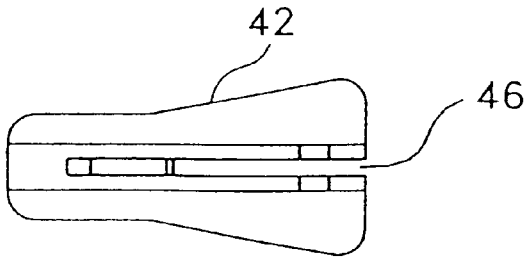
FIG. 7C

GROUND WORKING DEVICE

FIELD OF THE INVENTION

This invention relates to ground working devices.

BACKGROUND OF THE INVENTION

A road resurfacing unit is disclosed in U.S. Pat. No. 5,795,096 issued Aug. 18, 1998, which uses teeth to rip a gravel road prior to separating coarse material from fine material and depositing the coarse material on the fine material. It is desirable to have efficient separation of coarse and fine material. The design in U.S. Pat. No. 5,795,096 uses discs commonly used in farm implements. While these work satisfactorily, there is room for improvement. The inventor has proposed a solution to the need for improved separation.

SUMMARY OF THE INVENTION

Therefore, in one aspect of the invention, there is provided a ground working device, comprising a sub-frame having a first side and a second side, plural discs mounted for rotation on the sub-frame between the first side and the second side about an axis that extends from the first side to the second side; and a set of scoops mounted on each disc in ground contacting position. The scoops efficiently lift the ground surface material, which falls to the ground in a sorted manner with coarser material on top. In a further aspect of the invention, a motor is operatively connected to the plural discs for rotating the discs about the axis. Preferably, each scoop in each set of scoops has a ground working face that extends transversely to the disc on which the respective scoop is mounted. Also, preferably, the scoops each have concave ground contacting surfaces. Each scoop is preferably received in a respective slot in the disc in which the respective scoop is mounted. In a further aspect of the invention, there is provided a main frame on which the ground working device is mounted, the main frame being provided with ground engaging wheels. The sub-frame is preferably retractably mounted on the main frame. In use, the ground working device is preceded by a ripper bar mounted on the frame, which rips the ground surface. The ripper bar may be formed with retractable, replaceable teeth.

These and other aspects of the invention are described in the detailed description of the invention and claimed in the claims that follow.

BRIEF DESCRIPTION OF THE DRAWINGS

There will now be described preferred embodiments of the invention, with reference to the drawings, by way of illustration only and not with the intention of limiting the scope of the invention, in which like numerals denote like elements and in which:

FIG. 7B is a side view of a disc with five scoops according to the invention;

FIG. 7C is a face on view of a scoop according to the invention;

DETAILED DESCRIPTION OF PREFERRED EMBODIMENTS

Figure 1:
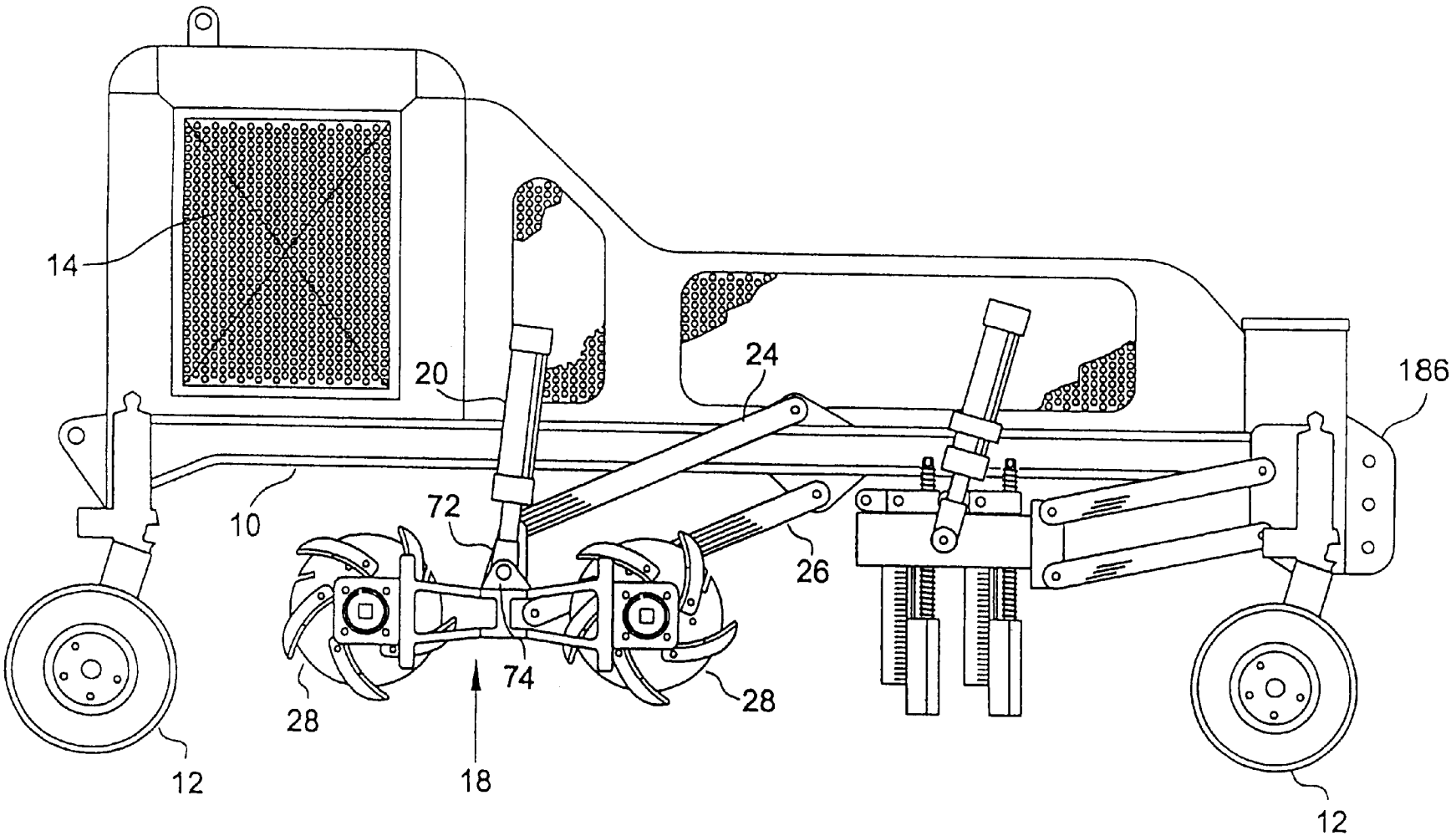
FIG. 1 is a side view of a ground working apparatus according to the invention, with a ground working device in travel position.
Figure 2:
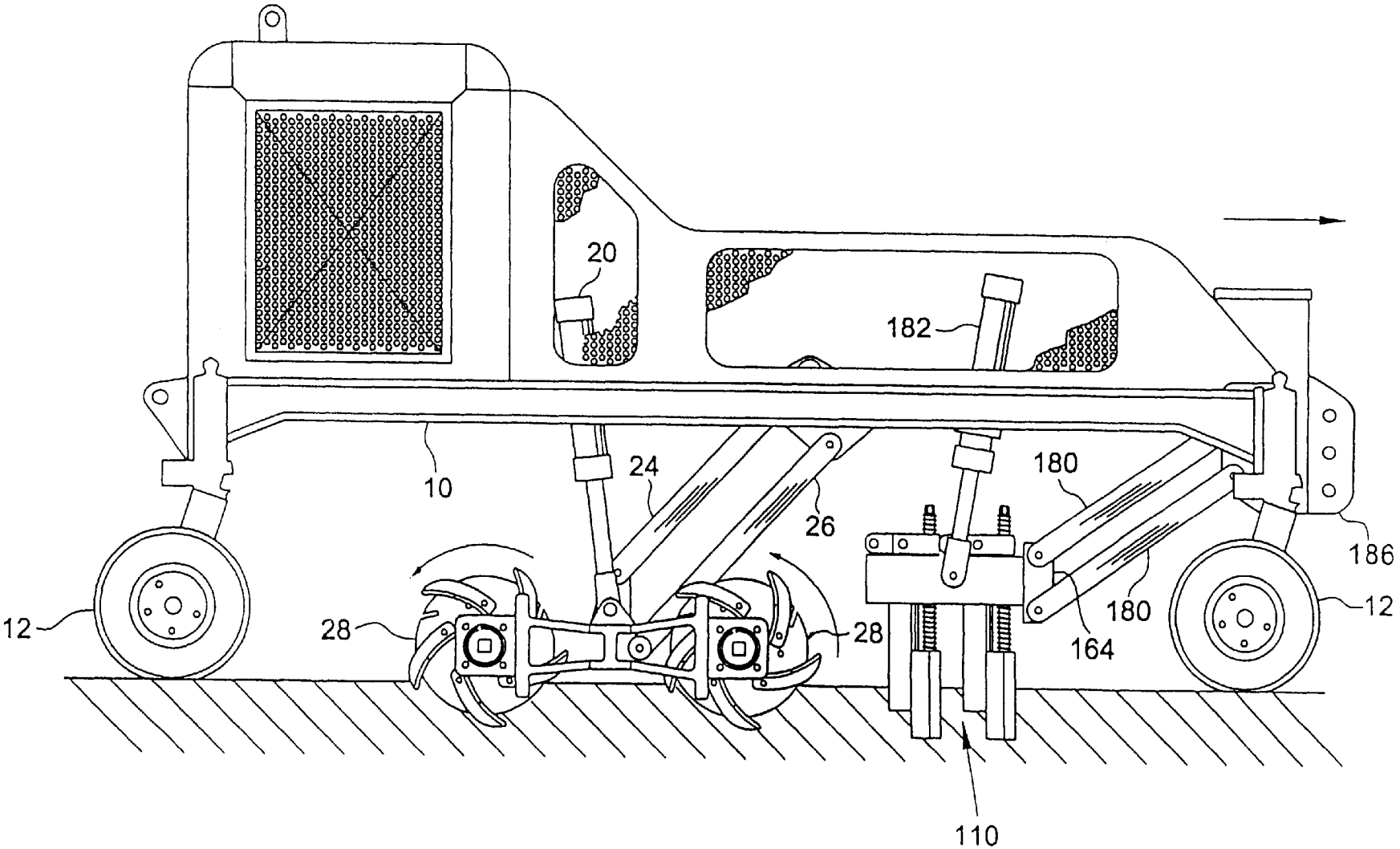
FIG. 2 is a side view of the apparatus of FIG. 1 with the ground working device in fully extended position.
Figure 3:
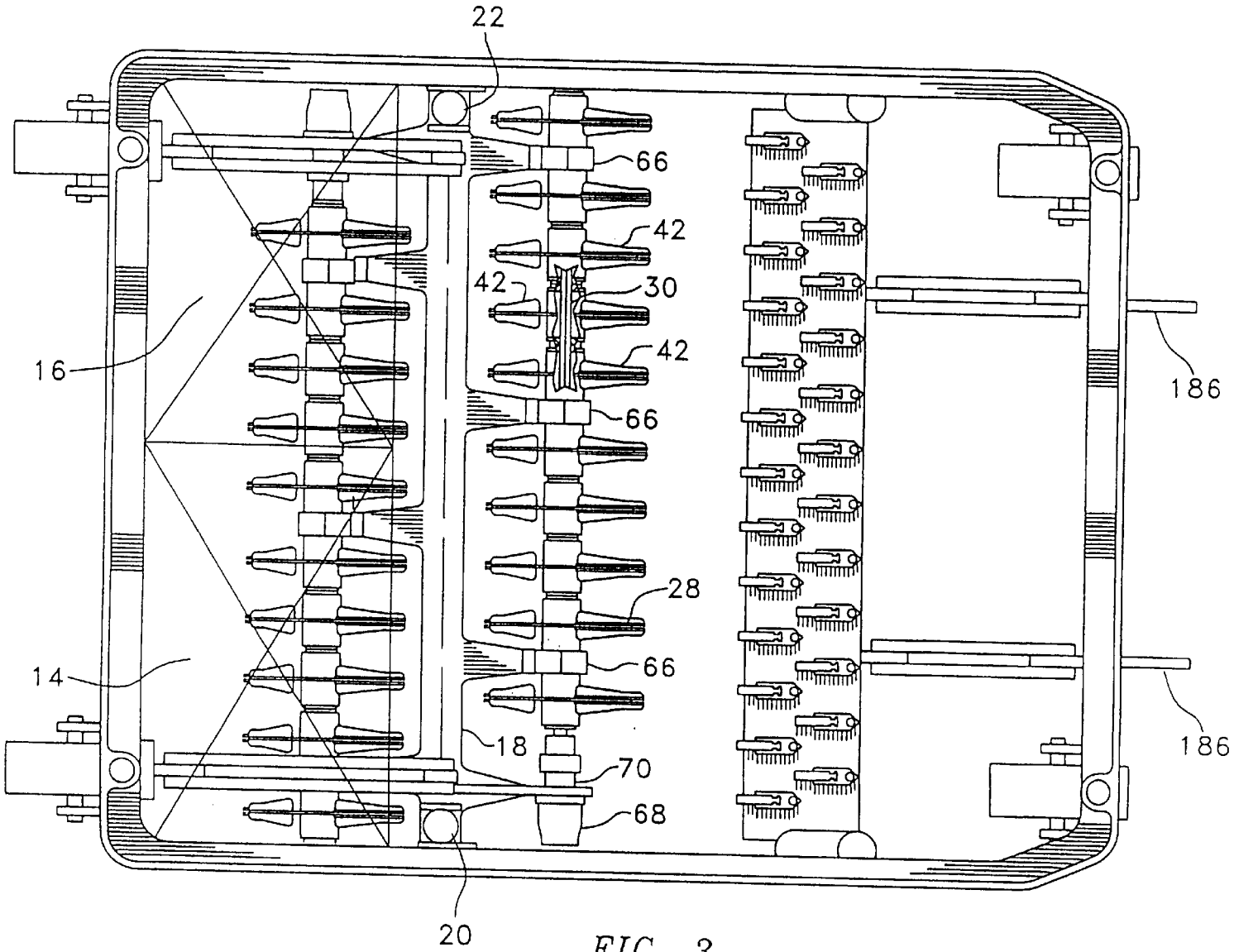
FIG. 3 is a top view of the apparatus of FIG. 1.
Figure 4:
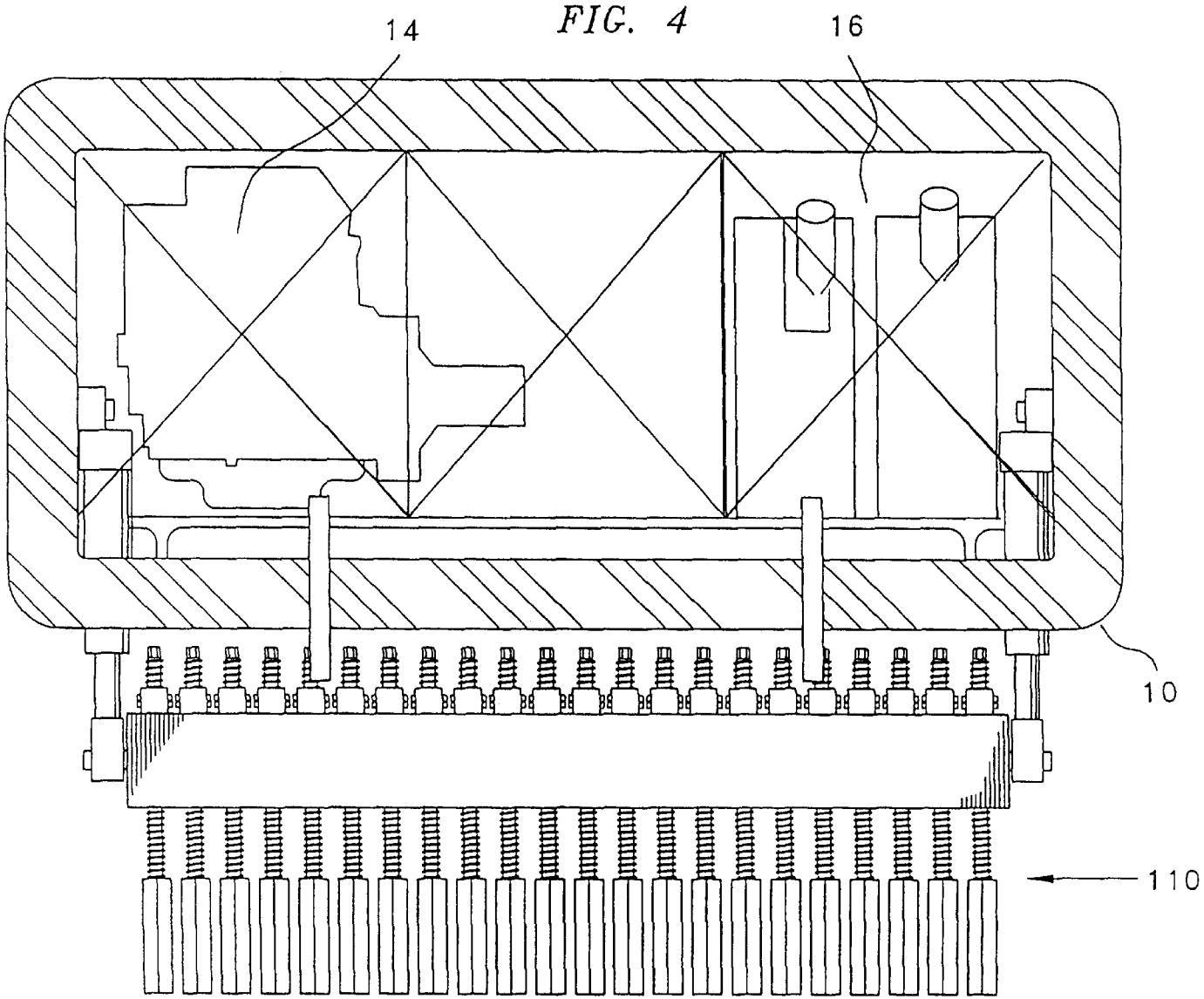
FIG. 4 is a front view of the apparatus of FIG. 1.
Figure 5:
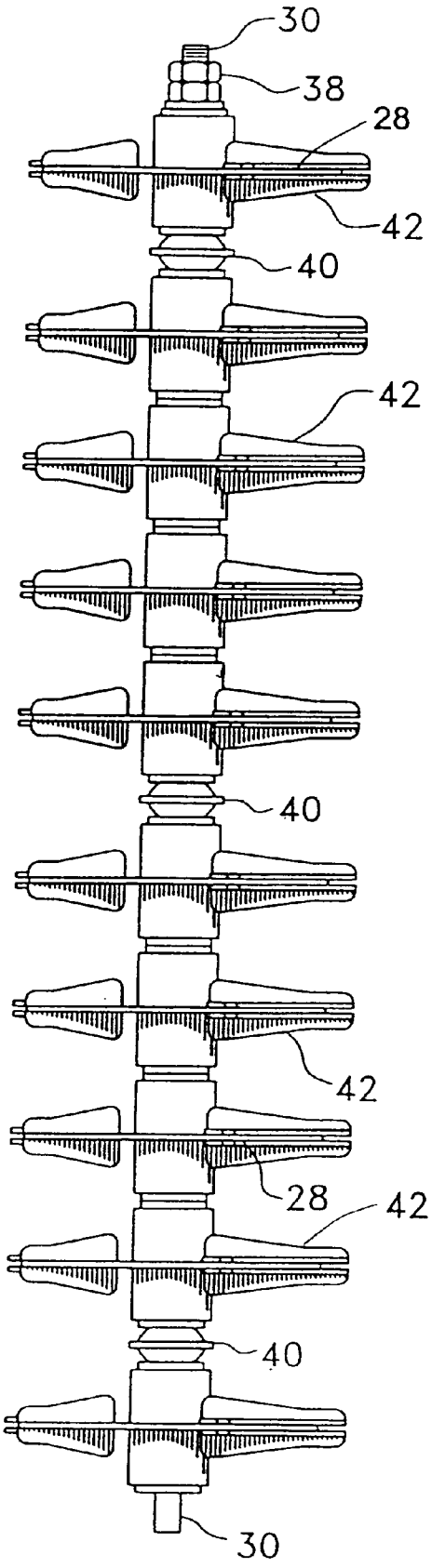
FIG. 5 is a top view of a sub-frame carrying discs with scoops according to the invention.

In this patent document, "comprising" means "including". In addition, a reference to an element by the indefinite article "a" does not exclude the possibility that more than one of the element is present.

Referring to FIGS. 1–4, the ground working apparatus is shown. A main frame 10 is supported by ground engaging wheels 12. A continuous track would also be considered ground engaging wheels for the purpose of this patent document. The main frame 10 carries a motor 14 and hydraulic section 16. A sub-frame 18 is attached under the frame 10 with hydraulic arms 20, 22 and swing arms 24 and 26. The hydraulic arms 20, 22 raise and lower the sub-frame 18 from the travel position shown in FIG. 1 to the maximum working position shown in FIG. 2, and may fix the sub-frame at working positions between the travel position and maximum working position. The swing arms 24, 26 hold the sub-frame 18 in a level position in relation to the ground, with each set of discs 28 on the sub-frame at equal height.

Figure 6:
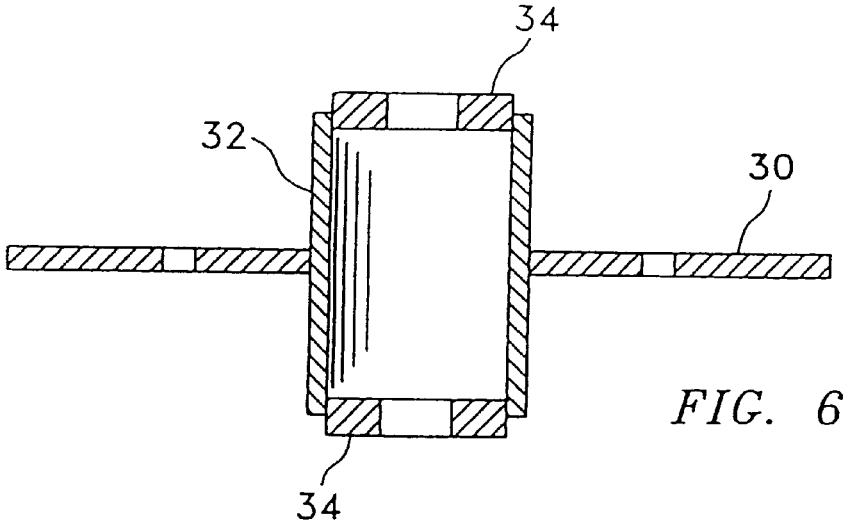
FIG. 6 is a cross-section through a disc according to the invention.
Figure 7A:
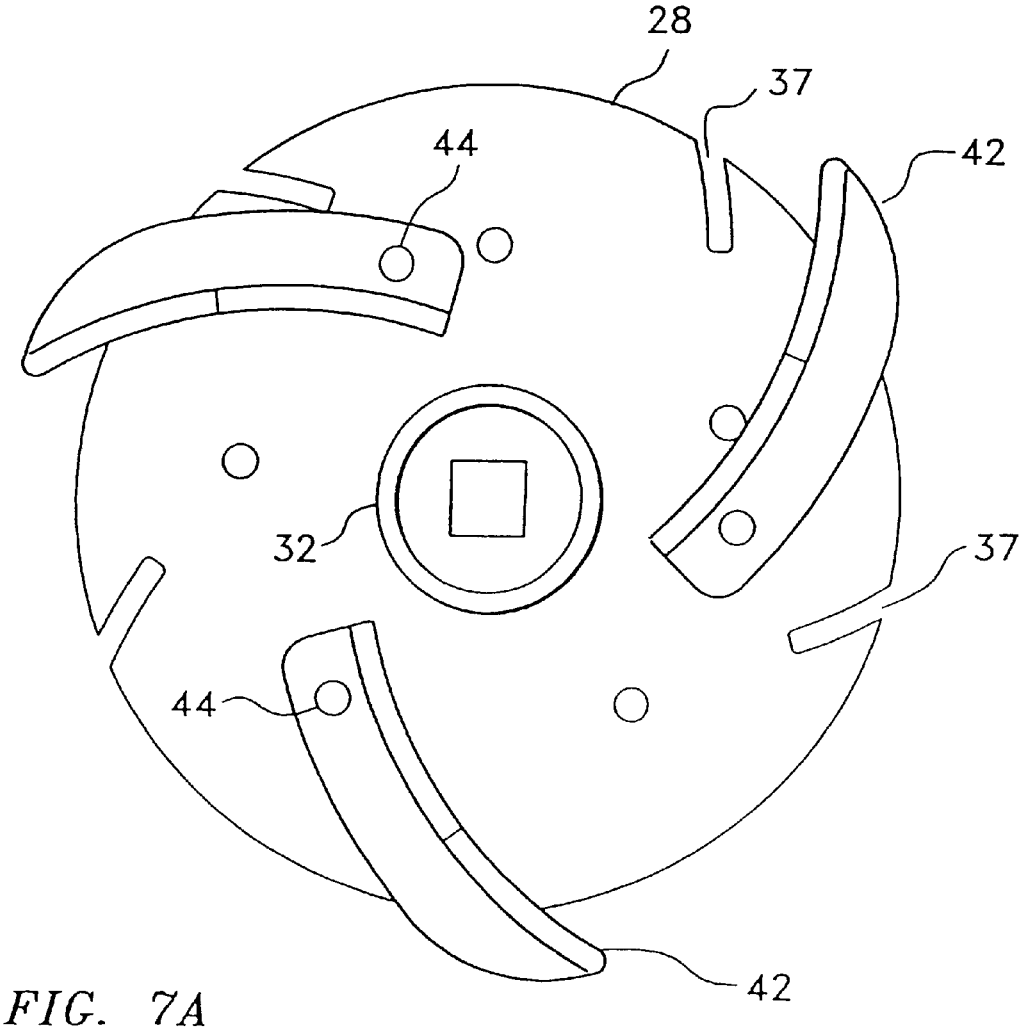
FIG. 7A is a side view of a disc with three scoops according to the invention.
Figure 8A:
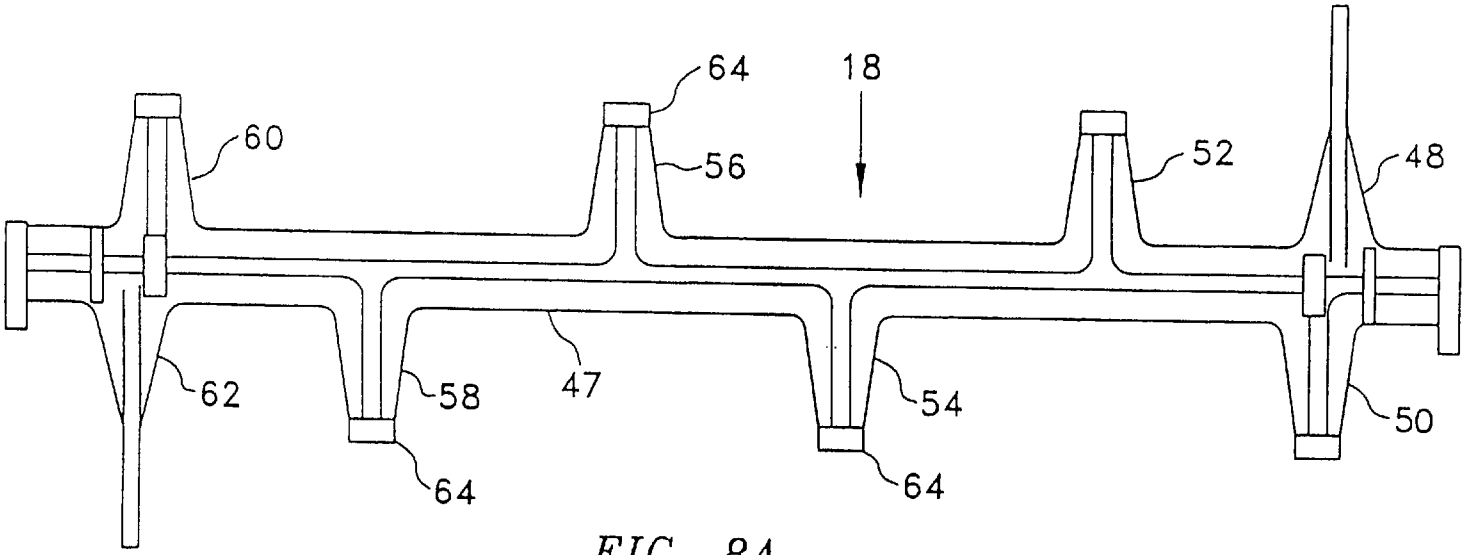
FIG. 8A is a top view of a sub-frame for carrying discs according to the invention.
Figure 8B:
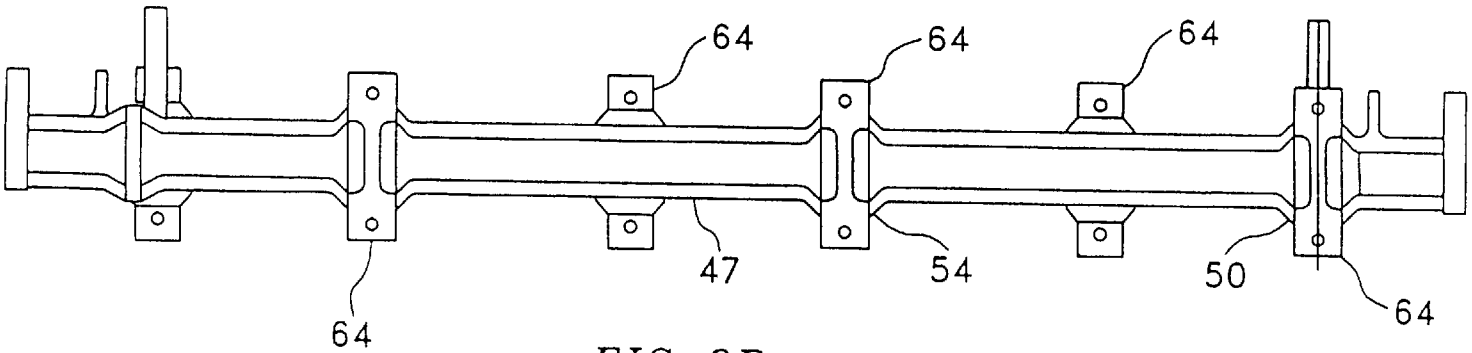
FIG. 8*b* is a side view of the sub-frame of FIG. 8A.
Figure 9:
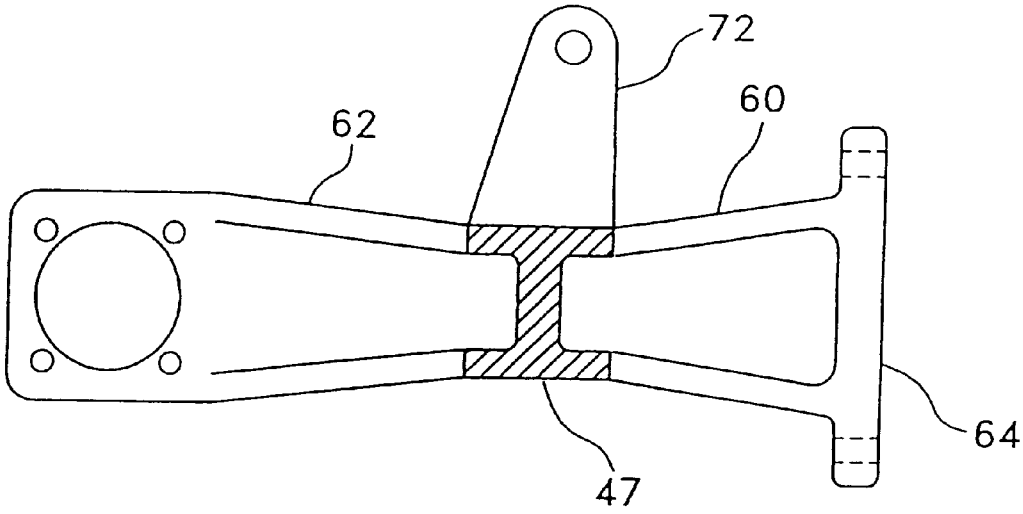
FIG. 9 is a partial side view, partial section, of one side of the sub-frame of FIG. 8*a;*
Figure 10:
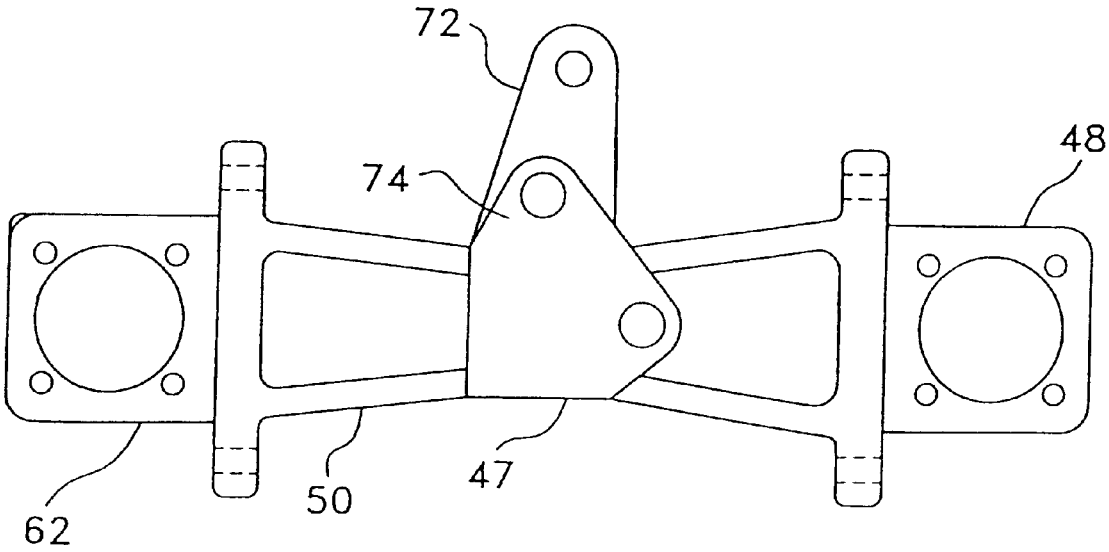
FIG. 10 is a side view of the other side of the sub-frame of FIG. 8A

The discs 28 (FIGS. 6, 7A, 7B) have square central holes and are received on a square rod 30 that extends from one side of the sub-frame 18 to the other. The rod 30 defines the axis about which the discs rotate. Each disc 28 is formed of a central cylindrical hub 32 with plates 34 at either end and a flat disc 36 extending out from the hub 32. The discs 28 are slotted at equal spaced intervals around their peripheries with slightly arcuate slots 37 extending inward from the respective peripheries. Seven slots are provided, with three of the slots equally spaced and five of the slots equally spaced, one of the slots being common to both the set of three and the set of five. The discs 28 are held on the rod 30 with nuts 38, and interspaced along the rod 30 are bearings 40. Scoops 42 are received in the slots 37 and secured with pins 44 which extend outward from an interior portion of the discs 28. The scoops 42 extend transversely of the discs 28 and have slots 46 that slide over the inner surface of the discs 28 so that the scoops 42 and discs 28 dovetail onto each other. The scoops 42 preferably have a concave ground working surface 50, to match the curvature of the slots 37. The scoops 42 extend radially outward past the outer circumference of the discs 28.

Referring to FIGS. 8A, 8B, 9 and 10, the sub-frame 18 is formed from a cental I-bar 47 with arms 48, 50, 52, 54, 56, 58 60 and 62 extending laterally from it. Arms 50, 52, 54, 56, 58 and 60 each terminate outwardly in a plate 64 to each which is secured, as by bolting, respective journal boxes 66. Bearings 40 are received in the journal housings 66. By this means the discs 28 are able to rotate, along with the rod 30, about the axis defined by the rod 30. Arm 48 receives one end of a forward set of discs 28 and arm 62 receives one end of a rearward set of discs 28. Each of the arms 48 and 62 carries a motor 68, a shaft 70 of which is operatively connected to the rod 30 for rotating the rod 30. The motors 68 may be any of various motors, but is preferably hydraulically driven by the hydraulic section 16. Lobes 74, which extend upward from the sub-frame 18 are connected to the hydraulic arms 20, 22 and lobe 72 is connected to the swing arms 24, 26. The discs 28 are arranged on the sub-frame 18 in such a position that the scoops 42 contact the ground when the sub-frame is lowered, without the sub-frame being so low that forward progression is impeded.

Figure 11:
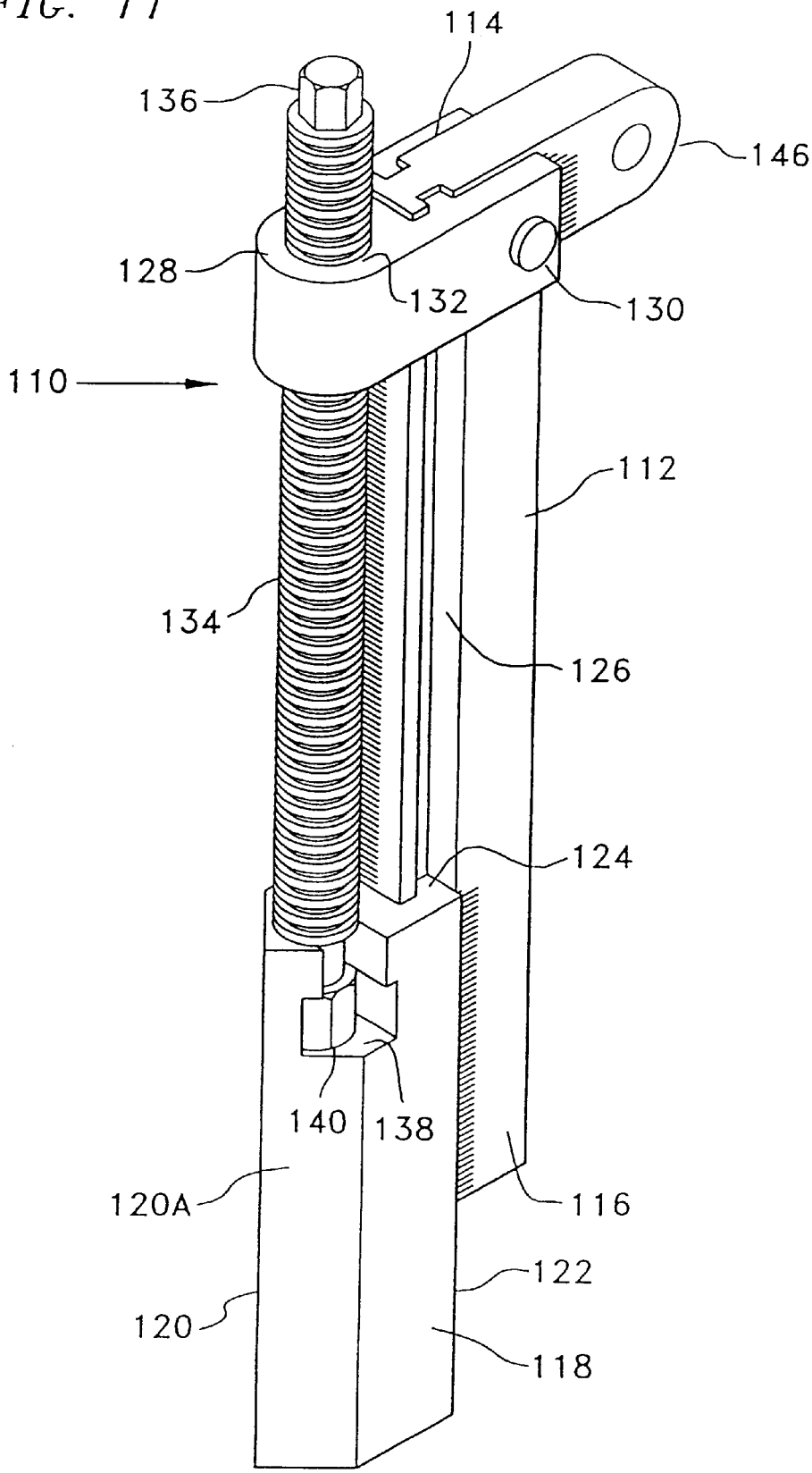
FIG. 11 is an isometric showing a retractable tooth assembly for use with a ground working apparatus according to the invention.
Figure 12:
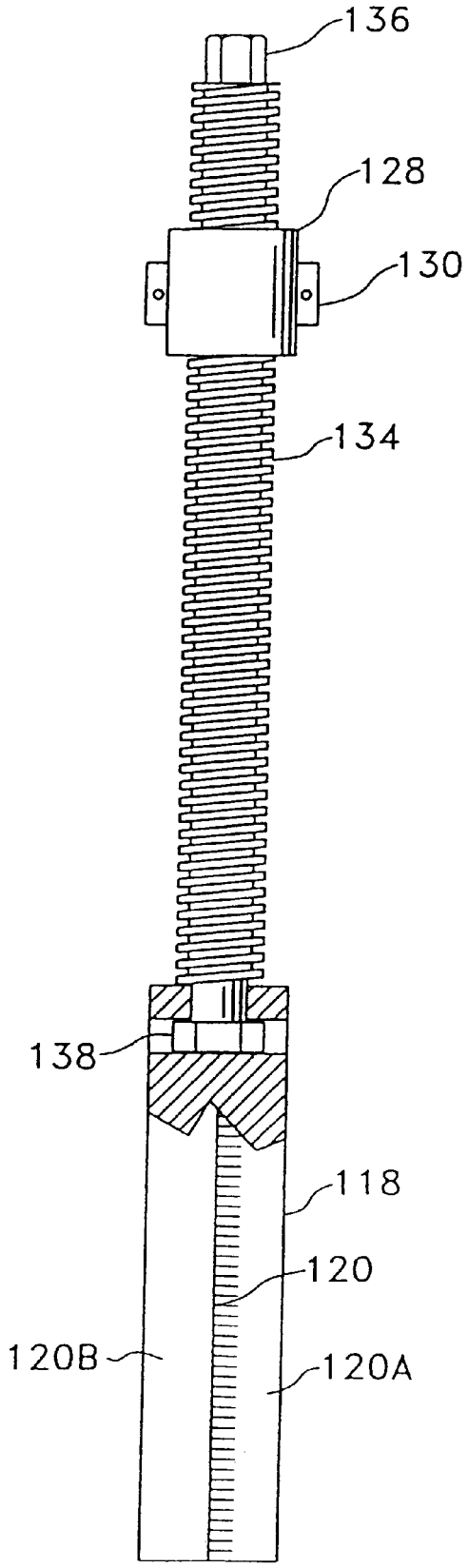
FIG. 12 is a rear view of the retractable tooth assembly of FIG. 11.
Figure 13:
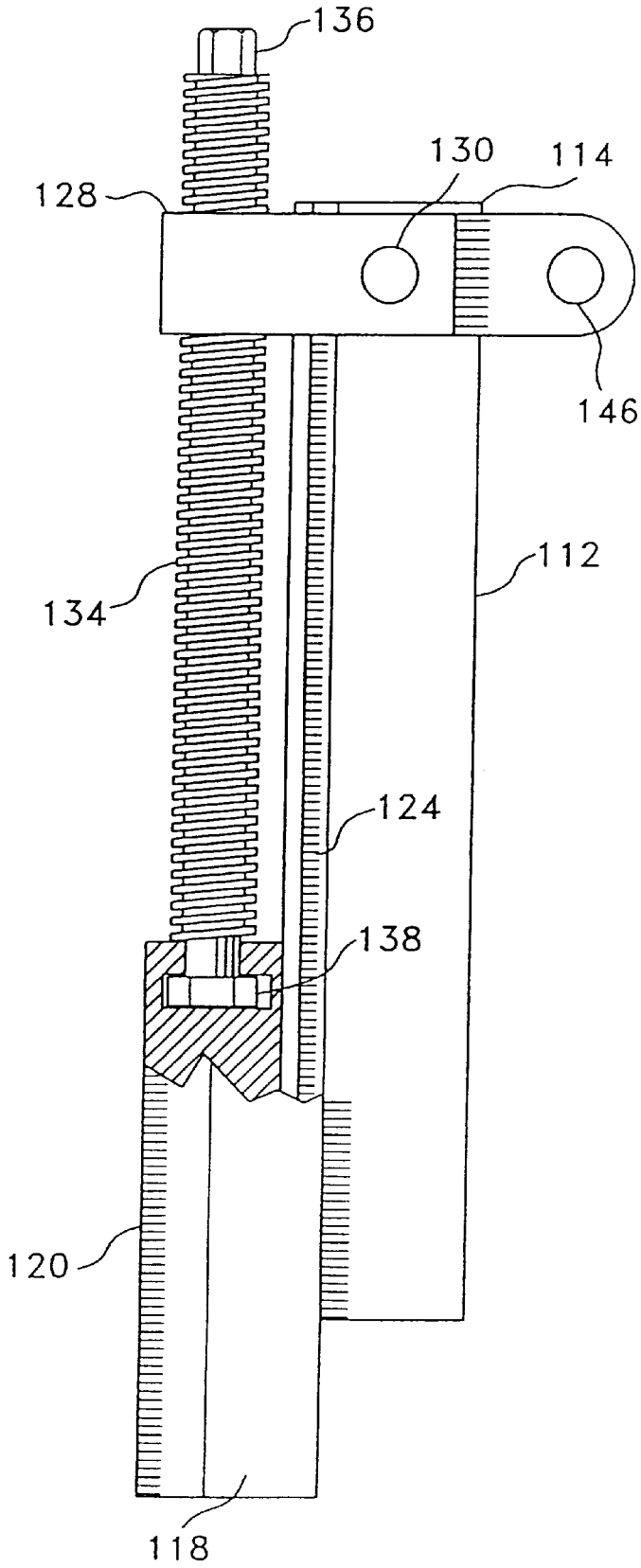
FIG. 13 is a side view of the retractable tooth assembly of FIG. 11.

Referring to FIGS. 11, 12 and 13, there is shown a retractable tooth assembly 110. The retractable tooth assembly 110 is formed of four main parts in the exemplary embodiment shown. First, there is a tooth carrier 112 having an upper end 114 and a lower end 116. Second, a tooth 118 is mounted for sliding on the lower end 116 of the tooth carrier 112. The tooth 118 has an edge 120, which when in use is the forward edge that rips the ground. The edge 120 is formed of two faces 120*a*, 120*b* meeting at an apex. The tooth 118 also has a rearward edge 122 in which is formed a groove 124 for receiving a tongue 126 on the tooth carrier 112. The tooth 118 is preferably formed of a harder wearing material than the tooth carrier 112. The edge 120 should be made of the hardest material that is economical in the intended use, as for example tungsten carbide.

Third of the four main parts forming the retractable tooth assembly 110 is a tooth position fixative 128 at the upper end 114 of the tooth carrier 112. The tooth position fixative 128 is formed of a yoke member, securely attached to the tooth carrier 112 as by a bolt 130, with a bore 132 through the member for receiving a position adjustable rigid link 134 connecting the tooth position fixative 128 and the tooth 118. The position adjustable rigid link 134, the fourth main part in the retractable tooth assembly 110 is preferably a constant diameter screw with exterior threads that mate with interior threads in the bore 132. The end 136 of the position adjustable rigid link 134 is formed as a hex nut to allow working the screw through the bore 132. The end 138 of the position adjustable rigid link 134 is formed as a cap rotatably received by a slot 140 in the upper end of the tooth 118.

The tooth 118 is thus adjustably located on the tooth carrier 112 by rotating the hex nut at the end 136 of the position adjustable rigid link 134. As the tooth 118 wears, its height may be adjusted. The tooth 118 is the part that takes most of the wear in use of the retractable tooth assembly 110. By this design, the tooth 118 may be readily removed from the tooth carrier 112 by slipping the cap at the end 138 out of the slot 140, and sliding the tooth 118 off the tooth carrier 112.

Various other mechanisms may be used for the tooth position fixative 128 and position adjustable rigid link 134. The mechanism shown is a screw received by a threaded opening. Alternatively, such devices as a rack and pinion or worm and screw and other similar devices may be used to advance and retract the tooth 118 on the tooth carrier 112.

Figure 14:
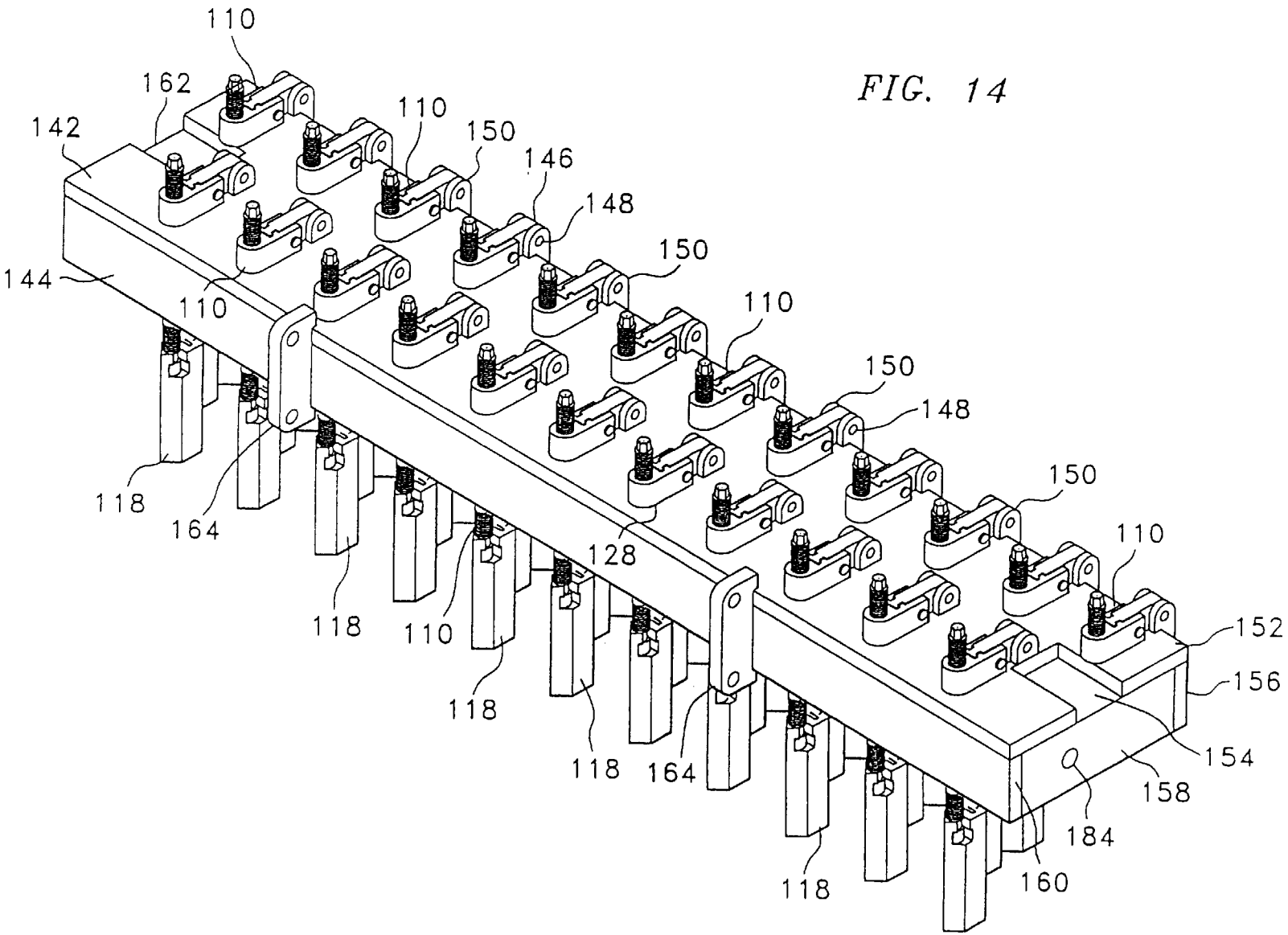
FIG. 14 is an isometric view of a ground working device with a retractable tooth assembly for use with a ground working apparatus according to the invention.

A mount for the retractable tooth assembly 110 is shown in FIG. 14. The mount comprises a frame 142, which may be part of various ground working equipment such as a grader, farm implement or a road working device of the type shown in U.S. Pat. No. 5,795,096 of Culver. The frame 142 has a lower surface 144, which is defined as the surface closest to the ground when the frame 142 is in worldling position. Teeth 118 are secured to the frame 142 and extend away from the surface 144 in a ground contacting array. The teeth 118, made as shown in FIGS. 11, 12 and 13, are individually retractable. Preferably, the teeth 118 are arranged in a rectangular array as shown, with many more teeth across the width than there are rows of teeth. Each tooth 118 is formed as part of a retractable tooth assembly 110, which extends through the frame 142 from the upper side of the frame 142 to the lower side. The retractable tooth assembly 110 is secured to the frame 142 on the first side and the tooth itself forms a working end on the second side.

The retractable tooth assembly 110 may be secured to the frame 142 using the tooth position fixative 128. The tooth position fixative 128 may for this purpose include a bar 146 secured to a shaft 148 extending between two posts 150 that are welded or otherwise secured to the frame 142. The frame 142 is formed of an upper plate 152 and lower plate 154 secured together in a casting process or by welding around their peripheries by plates 156, 158, 160 and 162. Mounting bars 164 are used to secure the frame 142 to swinging arms 180. The frame 142 is raised and lowered using hydraulic arms 182 attached to either side of the frame 10 and to the frame 142 with pins inserted into openings 184 in the frame 142. The height of the retractable teeth is controlled using hydraulic controls for the hydraulic arms 182. The frame 10 may be attached by any suitable means such as by plates 186 to a vehicle, such as a grader or tractor, that tows the apparatus across a road surface. While the invention as disclosed and claimed is a road resurfacing device, when applied to roads one of the objects of the invention is to restore, reconstruct and reshape the road as much as possible during the resurfacing process.

Immaterial modifications may be made to the invention described here without departing from the essence of the invention.

The embodiments of the invention in which an exclusive property or privilege is claimed are defined as follows:

1. A road resurfacing device, comprising:

a frame having first and second sides and a front end and a back end;

ground engaging supports at least at each of the front and back ends for supporting the frame on the ground;

a ripper bar extending from the first side to the second side;

a separator extending from the first side to the second side and located nearer to the back end than the ripper bar for separating fine material from coarse material ripped up by the ripper bar;

the separator comprising plural scoops mounted for rotation under the frame and movable between a ground engaging position and a travel position, the scoops being mounted to dig into and lift ground material as the frame advances over a road surface;

each scoop having a concave lifting face that extends parallel to the axis about which the scoop rotates; and means to attach the frame to a vehicle.

2. The road resurfacing device of claim 1 in which the plural scoops are mounted for rotation opposed to the direction of movement of the frame over the ground.

3. The road resurfacing device of claim 1 in which the ripper bar carries multiple replaceable teeth.

4. The road resurfacing device of claim 1 in which the scoops are mounted on discs, the discs being mounted on a rod extending transversely across the frame.

5. The road resurfacing device of claim 4 further comprising a motor operatively connected to the plural discs for rotating the discs about the axis defined by the rod.

6. The road resurfacing device of claim 4 in which each scoop is received in a respective slot in the disc in which the respective scoop is mounted.

* * * * *

UNITED STATES PATENT AND TRADEMARK OFFICE

CERTIFICATE OF CORRECTION

PATENT NO. : 6,368,014 B1 
DATED : April 9, 2002
INVENTOR(S) : Larry G. Culver and Ray W. Gillard It is certified that error appears in the above-identified patent and that said Letters Patent is hereby corrected as shown below:

Title page,
Insert Item
-- [30] Foreign Application Priority Data
Dec. 30, 1999 [CA] Canada . . . . . 2293885 --

Signed and Sealed this

Sixth Day of January, 2004

JAMES E. ROGAN
*Director of the United States Patent and Trademark Office*